US007562416B2

(12) United States Patent
Lautenschläger et al.

(10) Patent No.: US 7,562,416 B2
(45) Date of Patent: Jul. 21, 2009

(54) DAMPING DEVICE WITH A JOINT HINGE

(76) Inventors: Gerhard Wilhelm Lautenschläger, Backhausstrasse 29, Brensbach (DE) D-64395; Harald Helmut Ulrich, Lichtenbergstrasse 21, Fischbachtal (DE) D-64405; Markus Herper, Flutgraben 5, Mühltal (DE) D-64367

( * ) Notice: Subject to any disclaimer, the term of this patent is extended or adjusted under 35 U.S.C. 154(b) by 255 days.

(21) Appl. No.: 11/542,922

(22) Filed: Oct. 4, 2006

(65) Prior Publication Data

US 2007/0062366 A1 Mar. 22, 2007

Related U.S. Application Data

(62) Division of application No. 10/482,545, filed as application No. PCT/EP02/04915 on May 4, 2002, now Pat. No. 7,275,284.

(30) Foreign Application Priority Data

Jul. 6, 2001 (DE) ..... 201 11 085 U
Sep. 14, 2001 (DE) ..... 201 15 250 U

(51) Int. Cl.
*E05F 1/08* (2006.01)

(52) U.S. Cl. ..... 16/286; 16/50; 16/85; 16/375

(58) Field of Classification Search ..... 16/286–288, 16/366, 370, 374, 375, 86, 86 R, 86 A, 49, 16/51, 54, 68; 292/DIG. 15, DIG. 19; 49/386
See application file for complete search history.

(56) References Cited

U.S. PATENT DOCUMENTS 769,201 A 9/1904 Van Blarcom et al.
1,700,086 A * 1/1929 Sherwood ..... 16/85
1,934,288 A 11/1933 White
3,362,042 A 1/1968 Salice
3,363,281 A 1/1968 Borsani
3,763,519 A 10/1973 Favre
3,975,791 A 8/1976 Hettich et al.
4,075,735 A * 2/1978 Rock et al. ..... 16/278

(Continued)

FOREIGN PATENT DOCUMENTS

AT 004 213 U1 4/2001

(Continued)

*Primary Examiner*—Chuck Y. Mah
(74) *Attorney, Agent, or Firm*—Christa Hildebrand; Norris McLaughlin & Marcus, P.A.

(57) ABSTRACT

The invention relates to a damping device for parts of furniture which are joined together by means of hinges and which can be pivoted in relation to each other. The housing contains a damping fluid in the cavity thereof and a resistance element which can be displaced relative to the damping fluid and connected to an actuating element protruding from the housing. During at least one part of the pivoting movement of both pieces of furniture, said actuating element is drivingly connected to the second piece of furniture and transfers the movement distributed to the second piece of furniture to the resistance element. The damping device is arranged in the region of at least one of the hinges which pivotally couples both pieces of furniture, and whereby either the damping housing and/or the actuating element engages with one of the mounting element of the corresponding hinges, at least during the damping process.

2 Claims, 9 Drawing Sheets

U.S. PATENT DOCUMENTS

| | | | | |
|---|---|---|---|---|
| 4,426,752 | A | 1/1984 | Nakayama | |
| 4,449,269 | A * | 5/1984 | Sundermeier et al. | 16/50 |
| 5,012,551 | A | 5/1991 | Beneke et al. | |
| 5,269,043 | A | 12/1993 | Yang | |
| 5,419,013 | A | 5/1995 | Hsiao | |
| 5,697,068 | A | 12/1997 | Salvi et al. | |
| 6,327,457 | B1 | 12/2001 | Hashimoto | |
| 6,408,483 | B1 | 6/2002 | Salice | |
| 6,591,454 | B2 | 7/2003 | Brustle | |
| 6,684,453 | B2 | 2/2004 | Wang | |
| 2002/0046441 | A1 * | 4/2002 | Brustle | 16/254 |

FOREIGN PATENT DOCUMENTS

| | | | |
|---|---|---|---|
| DE | 28 00 334 | A | 7/1979 |
| DE | 37 41 712 | A1 | 6/1989 |
| DE | 195 22 254 | A | 1/1997 |
| DE | 299 10 626 | U1 | 1/2000 |
| DE | 201 07 068 | U1 | 8/2001 |
| DE | 201 07 426 | U1 | 8/2001 |
| DE | 10254375 | C1 * | 11/2003 |
| EP | 1 006 251 | A | 6/2000 |
| EP | 1 113 137 | A | 7/2001 |
| EP | 1469153 | | 10/2004 |
| GB | 21 80 297 | A | 3/1987 |
| JP | 6193335 | A | 7/1994 |
| WO | WO 03/093616 | * | 11/2003 |

* cited by examiner

Fig.10
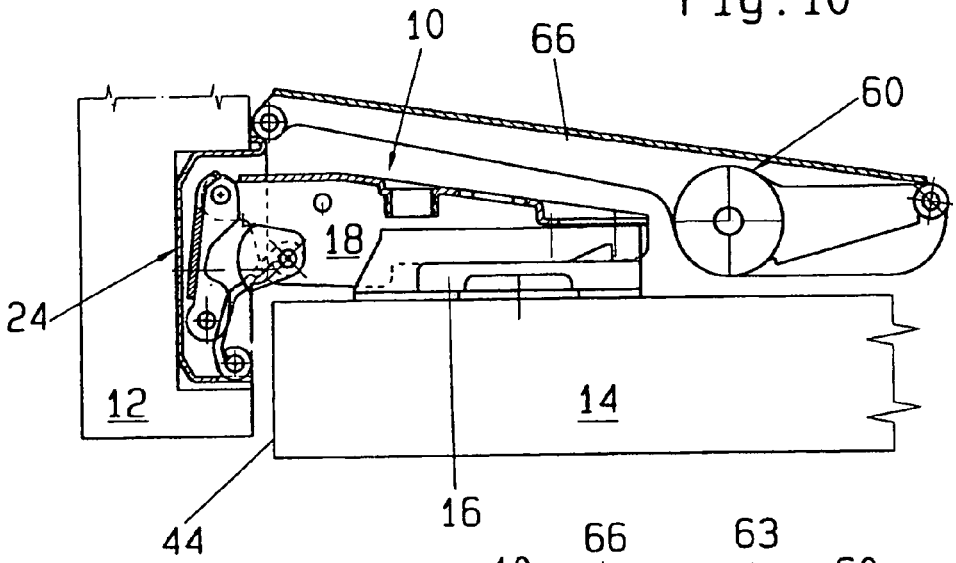
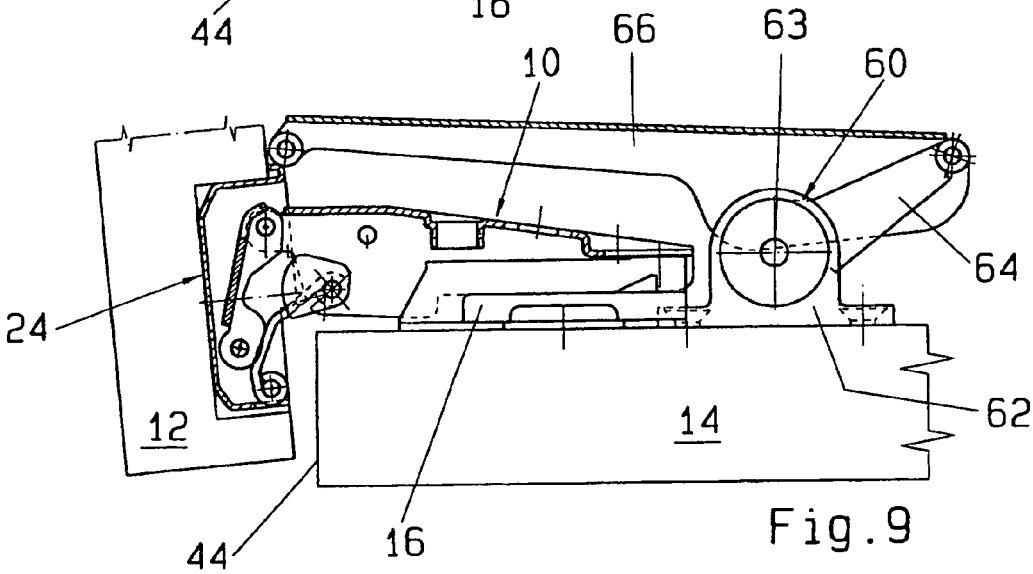
Fig.9
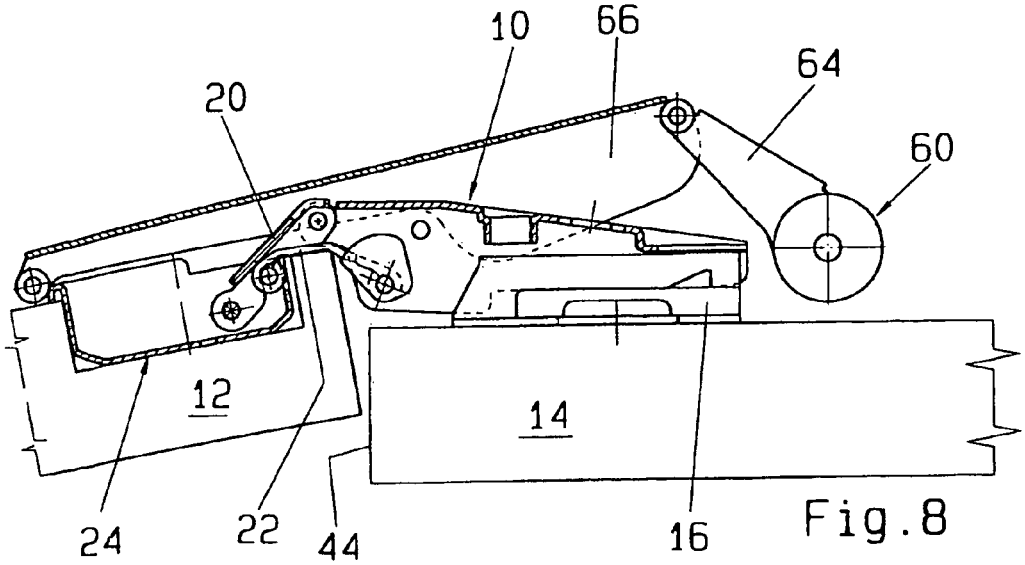
Fig.8

DAMPING DEVICE WITH A JOINT HINGE

This application is a divisional of U.S. application Ser. No. 10/482,545 filed on Dec. 30, 2003 now U.S. Pat. No. 7,275,284, which is a Sec. 371 application of PCT/EP02/04915 filed on May 4, 2002, claiming priority to German Application 201 11 085.7 filed on Jul. 6, 2001, and German Application 201 15 250.9 filed on Sep. 14, 2001, herein incorporated by reference.

BACKGROUND OF THE INVENTION

The invention relates to a damping device for pieces of furniture which are coupled with hinges and can be pivoted relative to each other, especially door leaves or folds which are mounted on the body of the piece of furniture. The damping device includes a damping housing that can be secured to one of the pieces of furniture and has a cavity containing a damping fluid and a resistance element which is displaceable relative to the damping fluid. The resistance element is coupled with an actuating element extending to the outside of the housing, and the actuating element is drivingly connected to the second piece of furniture during at least a portion of the relative pivoting motion of the two pieces of furniture and transfers the motion received from the second piece of furniture to the resistance element.

Damping devices on door leaves are used to eliminate or at least significantly reduce the stress and noise produced during when the cabinet doors are closed rapidly and/or forcefully, and by the impact-like brake action when the door leaf strikes the body. Damping devices of this type that operate with a gaseous medium, such as ambient air or viscous liquids, for example silicone oil, as a damping medium are known in the art. One of these conventional damping devices (DE 195 22 254 A1) is constructed so that the damping effect is produced by compressing the air contained in a cylindrical housing with a piston that is movably arranged in the housing, and by blowing the air out by a throttle action. The piston rod of the piston extends from the cabinet body when the door leaf is open, so that the door leaf during the closing operation contacts the free end of the piston rod and is then braked. In another conventional damping device (AT 004 213 U1), an elongated moveable rod that projects from the cabinet body is provided with teeth which engage via a pinion with a rotary damper which operates, for example, with silicone oil as a damping medium. When used in furniture construction, these damping devices are attached separately to the cabinet body in such a way that the rods or the piston rod that cushion the impact of the door leaf act on the interior region of the door leaf that faces the hinges. As a result, the damping devices are visible when the door leaf is open and the protruding portions of the actuating elements, i.e. of the piston rod or the other rods, extend to the outside of the cabinet body, making it dangerous to place items inside the cabinet or remove items from the cabinet, for example garments, since these items can catch on the portions of the actuating element protruding from the body of the piece of furniture and be damaged. In addition, there is also the risk that people can be injured.

SUMMARY OF THE INVENTION

It is therefore an object of the invention to provide a damping device for the door leaves of cabinets that eliminate the aforedescribed risks that items are caught on or persons are injured by the parts protruding from the interior of the cabinet. It is a further object to also obscure the damping device from view.

Starting from a damping device of the aforedescribed type, the object is solved by the invention in that the damping device is arranged in the region of at least one of the hinges that pivotally couple the two pieces of furniture, and that either the damping housing and/or the actuating element act at least during the damping process on one of the mounting elements of the corresponding hinge. By arranging the damping device(s) in the region of the hinges coupled to the body of the pivotable piece of furniture, items are no longer caught on the protruding actuating element when the piece of furniture is open, for example on an open door leaf, because the immediately adjacent open piece of furniture extends over the portion of the actuating element that protrudes from the body.

In one embodiment, the damping housing includes, in an essentially conventional manner, an elongated cylindrical cavity filled with the damping fluid, whereby a piston forms the resistance element that can move longitudinally in the cylindrical cavity. A piston rod forms the actuating element acting on the piston, wherein the end of the piston rod facing away from the piston extends to the outside of the damping housing.

Alternatively, the damping device can also be configured so that the damping housing has at least one cavity of circular cross-section and containing the damping fluid, with the resistance element being supported in the cavity of the damping housing on a shaft that is rotatable in the circumferential direction and extends at least on one end face of the damping housing to the outside of the damping housing. The actuating element in the form of a lever arm or a gear wheel is arranged on the end of the shaft that extends to the outside of the damping housing.

According to one embodiment, the damping housing can be arranged on the support-wall-side mounting element of a pivotable hinge configured for pivotally coupling the door leaf to the corresponding body of a cabinet, so that the section of the actuating element located outside the damping housing is oriented so as to be drivingly connected with the door-leaf-side mounting element or with a region of the door leaf directly adjacent to the door-leaf-side mounting element at least during a final part of the closing motion of the door leaf.

Advantageously, the damping housing can be arranged on the upper web wall, that faces away from the support wall, of the support wall mounting element of the furniture hinge. The mounting can be formed as an elongated hinge arm, and the free end of the actuating element that extends to the outside of the damping housing can be oriented towards the inside of the door leaf.

A buffer that moderates a damping impulse produced when the door leaf closes and contacts the piston rod can be disposed on the free end of the piston rod. Advantageously, the buffer is formed so as to be resiliently compressible in the direction of the longitudinal center axis of the piston rod.

Alternatively, a cover can be provided on the section of the piston rod that protrudes from the damping housing, whereby the cover is guided for longitudinal movement on the damping housing, which then assumes the function of the buffer and also covers the piston rod.

The impact when the door leaf strikes the cover can be lessened by advantageously arranging the cover, which is guided for longitudinal movement on the damping housing, on the section of the piston rod that protrudes from the damping housing, so as to be moveable in the longitudinal direction by a predetermined distance, and by arranging between the piston rod and the cover housing a spring that is elastically compressible in the direction of the longitudinal center axis of the piston rod.

According to an advantageous embodiment, the free end of the piston rod can be guided for longitudinal movement in a bore having an unobstructed cross-section that is complementary to the cross-section of the piston rod in a projection that protrudes from the inside of the end wall of the cover to the damping housing. The spring can be formed as a coil spring that is supported on the side of the damping housing on a disk disposed on the piston rod and is supported at the opposite end region on the end wall of the cover.

Advantageously, the cover can additionally be held and guided by a longitudinal guide so as to be displaceable by a predetermined distance in the longitudinal direction on the damping housing. According to an advantageous embodiment of the invention, this is accomplished by providing on the damping housing two pins that protrude diametrically from opposing sides, wherein each of these pins engages in a corresponding groove or slot disposed in the opposite wall of the cover. The width of the slot or groove thereby corresponds essentially to the diameter of the associated pin, while the maximum possible longitudinal displacement of the cover of relative to the damping housing is adjusted by suitably selecting the length of the slot or the groove, respectively.

The damping housing can also be arranged on the door-leaf-side mounting element of a furniture hinge that is formed as an articulated hinge and configured for pivotally mounting the door leaf on the corresponding body of a cabinet. The region of the actuating element located outside the damping housing is oriented so as to be in drivingly connected with the support wall mounting element at least during a final part of the closure motion of the door leaf.

The damping housing can be an integral part of the door leaf mounting element, or alternatively can be implemented as a separate component that is arranged on the door leaf directly adjacent to the door leaf mounting element.

According to a particularly advantageous embodiment of the invention, the damping housing can include two spaced-apart cavities filled with a damping fluid, whereby a toothed gear wheel is arranged on the ends of each of the shafts that protrude from the damping housing and rotatably support the resistance elements in the cavities. The toothed gear wheels mesh with a gearing disposed on opposing longitudinal edges of a slider, wherein the free end of the slider is drivingly connected with one of the hinge mounting elements during a final portion of the closing motion of the door leaf.

The hinge to be damped can be implemented as a joint hinge, wherein the rearward end of one of the joint arms, that is oriented towards the interior of the body, is coupled with the support wall mounting element so as to enable both a longitudinal motion by way of a sliding guide and a pivoting motion. The sliding guide is formed by a respective one of two grooves disposed in parallel, spaced-apart side faces of the support wall mounting element that is formed as an elongated body, and a corresponding pin disposed in parallel lateral cheeks of the joint arms that extend over the side faces. The pins engage with the corresponding grooves. Advantageously, the damping device can be arranged in an elongated cavity That is located intermediate between the side faces of the support wall stop element mounting element and is open on the end of the support wall mounting element facing the interior of the body. The grooves that form a portion of the sliding guide are continuous from the side faces of the support wall stop mounting element to the cavity. This allows a configuration, wherein the free end of the piston rod of the damping device is secured to the door-leaf-side front end of the elongated cavity, whereas the other end is moveable in the damping housing implemented as a damping cylinder. In this way, the free inner ends of the pins that protrude from the cheeks of the joint arm through the grooves into the elongated cavity can be drivingly connected with the damping cylinder. This drive connection can be implemented, for example, as a bayonet connection, whereby the free ends of the pins can be inserted into correspondingly formed recesses in the damping cylinder and locked by a rotation.

BRIEF DESCRIPTION OF THE DRAWINGS

The invention is described in more detail in the following description of several embodiments to be read in conjunction with the drawings, which show in:

FIGS. 8 to 10 views of a hinge depicted in a longitudinal cross-section that pivotally couples a door leaf to the support wall of the body of a cabinet, wherein the hinge is provided with a third embodiment of a damping device according to the invention, with the door leaf shown in a completely open position, in an almost closed position, and in a completely closed position;

DETAILED DESCRIPTION OF THE INVENTION

Figure 2:
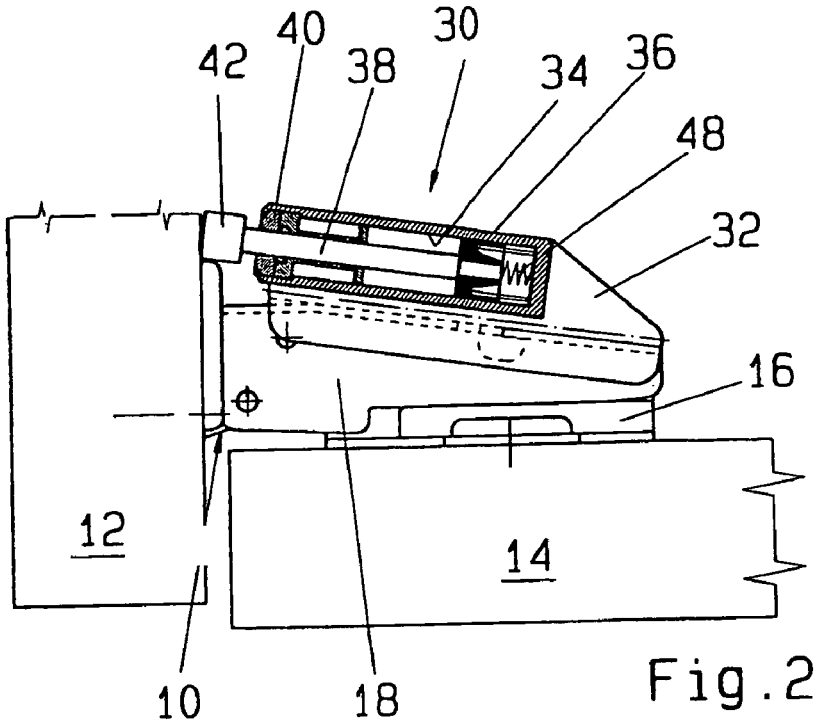
FIG. 2 a view corresponding to that of FIG. 1, wherein the door leaf is closed and the damping devices is shown in a partial longitudinal center cross-section.
Figure 1:
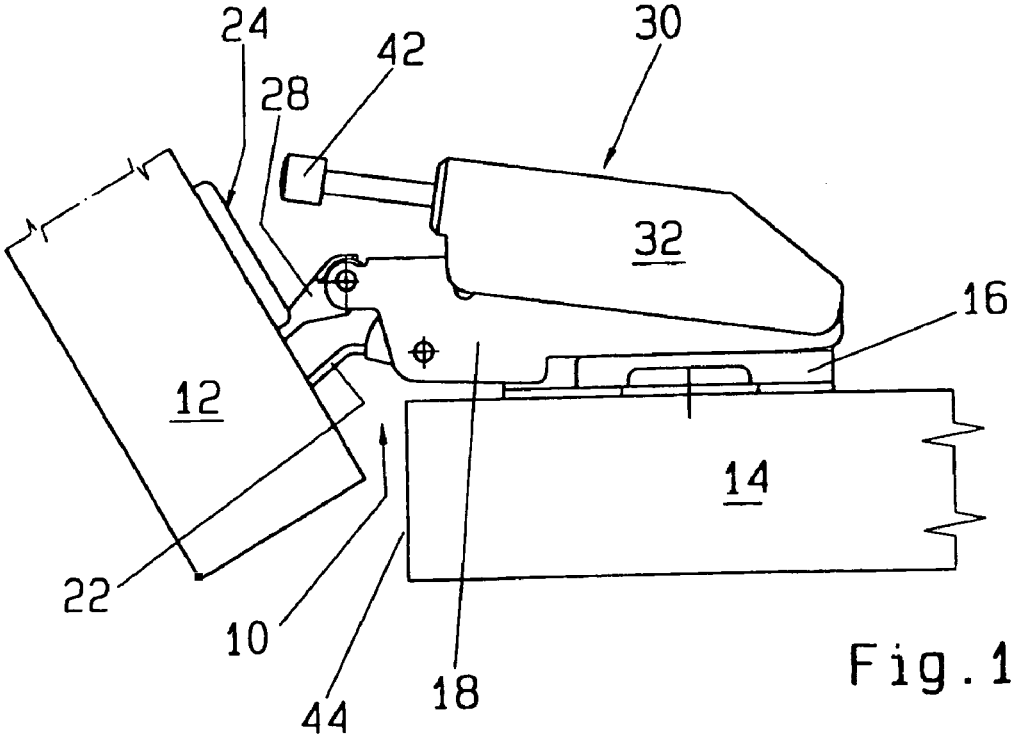
FIG. 1 a side view of a furniture hinge that pivotally couples the door leaf of a cabinet to the support wall of the cabinet body, whereby the mounting element associated with the body includes a first embodiment of a damping device according to the invention, shown here in a partially opened position of the door leaf.

FIGS. 1 and 2 show a furniture hinge, designated with the reference numeral 10, and formed as a four-bar hinge, which is used to pivotally connect a door leaf 12 to the support wall 14 of a cabinet body. The hinge 10 is formed as a conventional four-bar hinge. A support arm 18 which is adjustably secured on a mounting plate 16 attached to the support wall 14, is coupled via two connecting rods 20 and 22 with a hinge cup 24 that can be secured in a recess in the door leaf 12.

A damping device 30 is attached to the support arm 18. The damping device 30 has a damping housing 32, with an elongated cylindrical cavity 34 formed therein. A piston 36 is arranged in the cavity 34 for longitudinal displacement, and a piston rod 38 is attached to the end face of the piston 36 facing the door leaf. The piston rod 38 is sealingly guided through a plug 40 that closes the cavity 34 and has on its free end a buffer 42 which slightly projects over the front edge 44 of the support wall when the door leaf is open (FIG. 1). When the open door leaf 12 is closed, its inside surface contacts the buffer 42 before reaching the closed position (FIG. 2) and when the closing action continues, displaces the piston 36 via the piston rod 38 in the cavity 34 into the position depicted in FIG. 2. The cavity 34 is filled with a damping medium in the form of a damping fluid or a damping gas, so that the piston 36 can only be closed against a resistive force that depends also on the displacement speed, which dampens—via the piston rod 38 and the buffer 42—the closure motion of the door leaf 12, thereby preventing a sudden closure motion of the door leaf 12 which can cause a banging noise.

When the door leaf 12 is subsequently opened, the inside surface of the door leaf lifts from the buffer 42, so that no opening resistance is produced. The piston includes suitably calibrated throttle openings that are optionally provided with check valves, and therefore offers only a small resistance to a displacement in the cavity 34 in the direction of the door leaf. Consequently, the piston can be returned into its initial position by a relatively weak spring 48.

Figure 4:
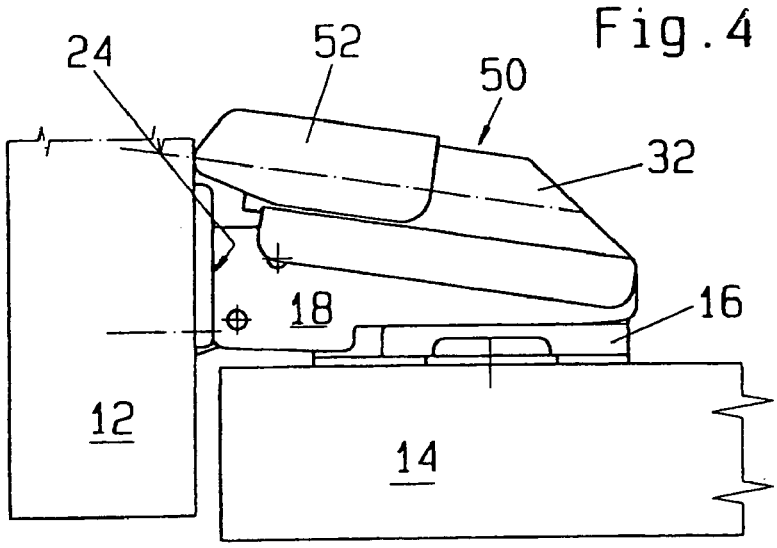
FIG. 4 a view corresponding to that of FIG. 3, with the door leaf in the closed position.
Figure 5:
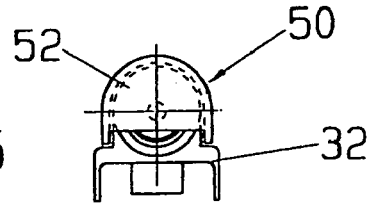
FIG. 5 a front view of the second embodiment of the damping device, as viewed in the direction of the arrow 5 in FIG. 3.
Figure 3:
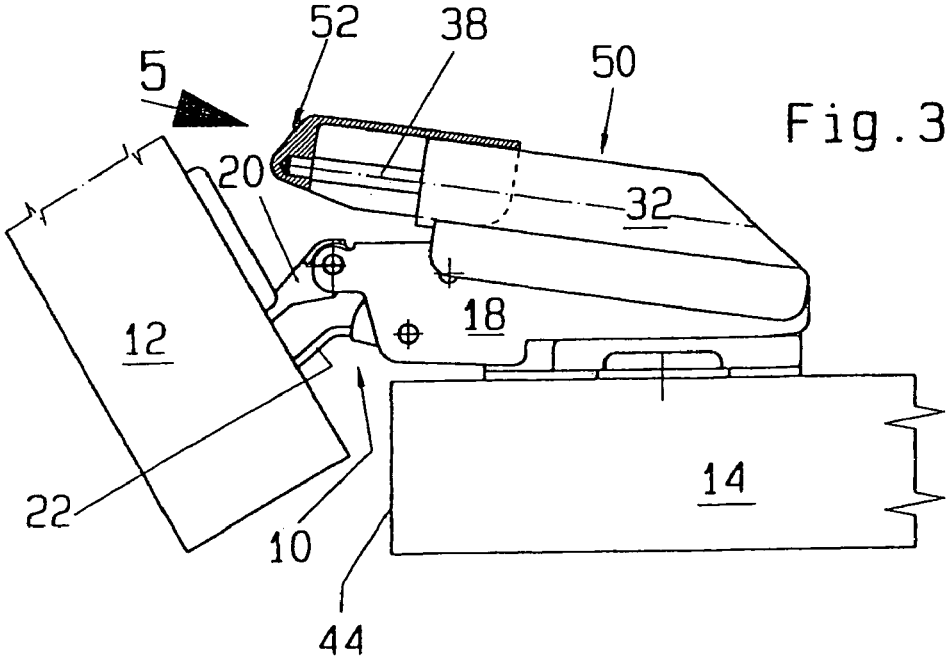
FIG. 3 a view of a piece of furniture corresponding to that of FIG. 1, with a modified second embodiment of a damping device of the invention, and with the door leaf in a partially closed position.

FIGS. 3 to 5 describe a damping device 50 which is essentially similar to the damping device 30 described above with reference to FIGS. 1 and 2, except that the buffer 42 in the damping device 50 is implemented as a cover housing 52 for the piston rod 38 that protrudes from the damping housing 32. Since the construction and the operation of the damping device 50 is identical to the damping device 30 already described above and since identical elements of the damping devices as well as of the depicted hinge and its components are designated in the Figures with the same reference numerals, reference is here made to the preceding description.

Figure 7:
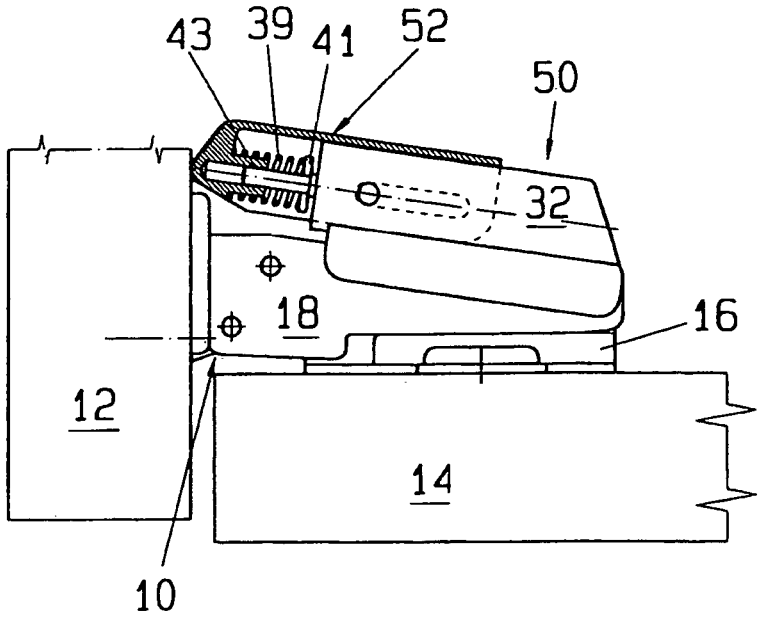
FIGS. 6 and 7 views of a damping device which corresponds to one of the damping devices according to FIGS. 3 to 5 and is provided in addition with an elastic impact damper, in the positions of the door leaf depicted in FIGS. 3 and 4, respectively.
Figure 6:
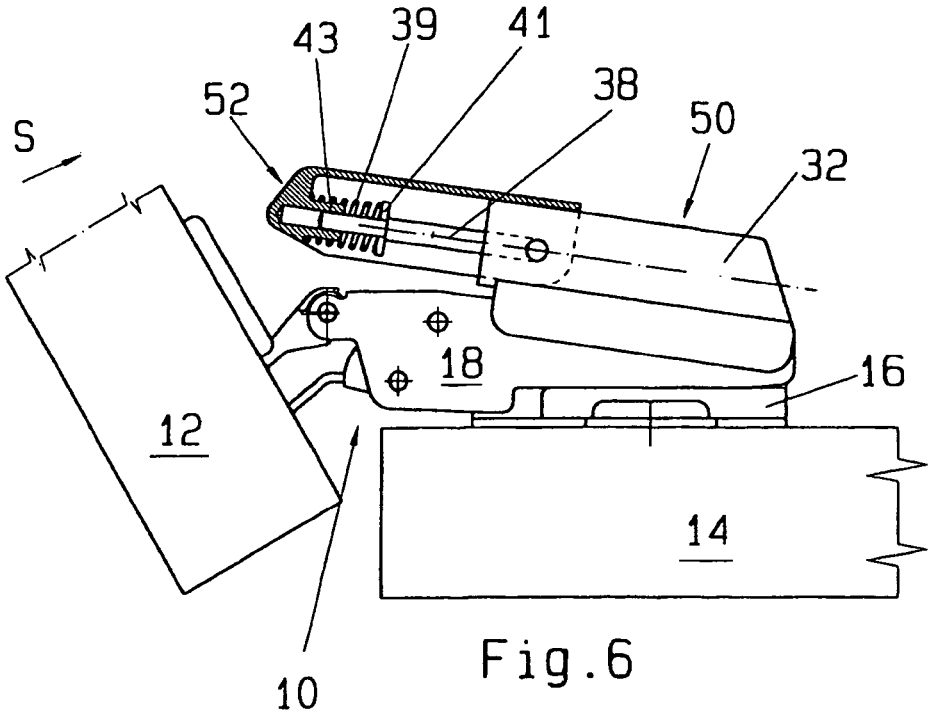

The hinge 10 depicted in FIGS. 6 and 7 has a damping device that is functionally identical to the damping device 30 described above with reference to FIGS. 3 to 5 of the second embodiment, except that the end of the piston rod 38 facing the door leaf is not rigidly connected to the cover 52. The outer free end of the piston rod 38 which has a smaller diameter, is supported in a bore for longitudinal displacement. The bore is formed in a projection 43 which protrudes from the inside of the end wall of the cover 52 towards the damping housing 32. A coil spring 39, which is supported, on one hand, on the inside of the end wall of the cover 52 and, on the other hand, on a disk 41 disposed of the piston rod 38, maintains in its uncompressed state the free end of the piston rod 38 in a position where the free end is partially pulled out of the bore located in the projection 43, as shown in FIGS. 6 and 7. When the door leaf 12 is rapidly closed in the closure direction indicated in FIG. 6 by the arrow s, the inside of the door leaf 12 strikes the outside of the end wall of the cover 52 when approaching the closed position. The generated impact, however, is not directly transferred to the piston rod 38, but initially causes a displacement of the piston rod into the interior of the bore located in the projection 43, whereby the coil spring 39 is simultaneously compressed. This diminishes the impact stress by causing a pre-compression of the coil spring 39. This pre-compression is then transferred during the final closure process to the piston rod 38 by relaxing the coil spring 39. This approach further enhances the impact damping produced by the elastic buffer 42 in the embodiment depicted in FIGS. 1 and 2.

To prevent the door leaf 12 from separating or suddenly detaching from the damping housing 32 when the door leaf 12 strikes the cover 52, two short pins 33 are provided on the damping housing which project diametrically from the outside wall of the damping housing and engage with corresponding grooves 53 in the opposing wall of the cover 52. Pins 33 and grooves 53 form longitudinal guides which allow a predetermined longitudinal displacement of cover 52 relative to the damping housing 32, while also preventing the cover from the lifting off the damping housing by way of a formfitting engagement between a pin 33 and a corresponding groove 53.

FIGS. 8 to 10 show schematically another embodiment of a damping device for furniture hinges, with a damping configuration that is functionally different from the damping devices used in the preceding embodiments. A so-called rotary damper is employed which includes resistance elements in the form of damper paddles, etc., disposed on a shaft extending through the space filled with a damping medium. The space has a circular cross-section and is filled with a high viscosity damping medium, such as silicone oil. At least one end of the shaft extends through the end wall to the outside of the space that is filled with the damping medium.

FIGS. 8 to 10 schematically depict an embodiment of a rotary damper 60, which is formed on a bearing block 62 disposed on the end of the support arm 18 of the hinge 10 inside the body and also forming the housing of the rotary damper. A lever arm 64 is rotatably secured to the end of the shaft 63 of the rotary damper that protrudes from the housing 62. The lever arm 64 is hingedly connected to an elongated linkage member 66 having an essentially U-shaped profile, whereby the opposite end of the linkage member 66 is hingedly coupled to the hinge cup 24. As seen in the Figures, the lever arm 64 and the connected linkage member 66 are essentially in a stretched position when the door leaf 12 is completely open (FIG. 6). When the door leaf 12 is closed, the lever arm 64 is pivoted towards the cabinet interior by the connected end of the linkage member 66, which moves into the interior body of the corresponding cabinets. The resistance elements disposed in the interior of the cavity of the rotary damper that is filled with silicone oil and has a circular cross section, are rotated in the same direction. The silicone oil enclosed in the cavity and representing the damping medium builds up a velocity-dependent resistive force which opposes the closure motion of the door leaf 12 by providing a corresponding resistance, i.e., a damping resistance that opposes closure of the door leaf.

It is evident that by constructing the damping device in the aforedescribed manner and by coupling the damping device to the hinge 10 with the linkage member profile 66, the hinge is covered up in its completely open position, so that the linkage member 66 provides an additional functionality by preventing, for example, clothing hanging in the cabinet from getting caught in the hinge mechanism, as well as accidentally pinching and injuring a finger in the hinge region.

Figure 12:
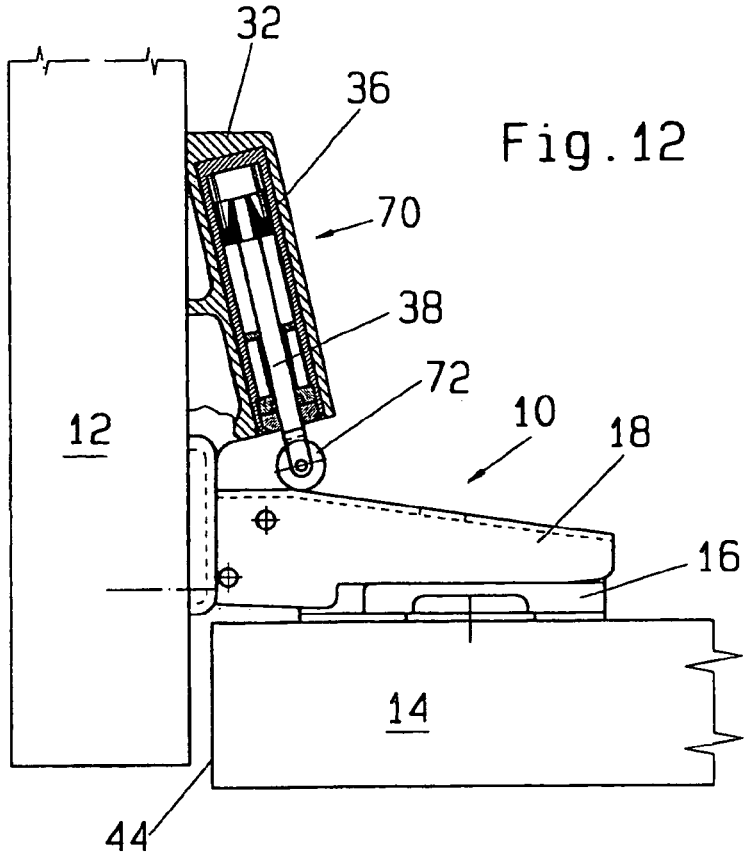
FIGS. 11 and 12 views of a hinge with a fourth embodiment of a damping device which in this case is integrally connected with the mounting associated with the door leaf FIG. 13 a perspective view of a hinge that pivotally connects a door leaf with the support wall of the body of a cabinet, with a fifth embodiment of a damping device arranged directly after the mounting element of the hinge that faces the door leaf.
Figure 11:
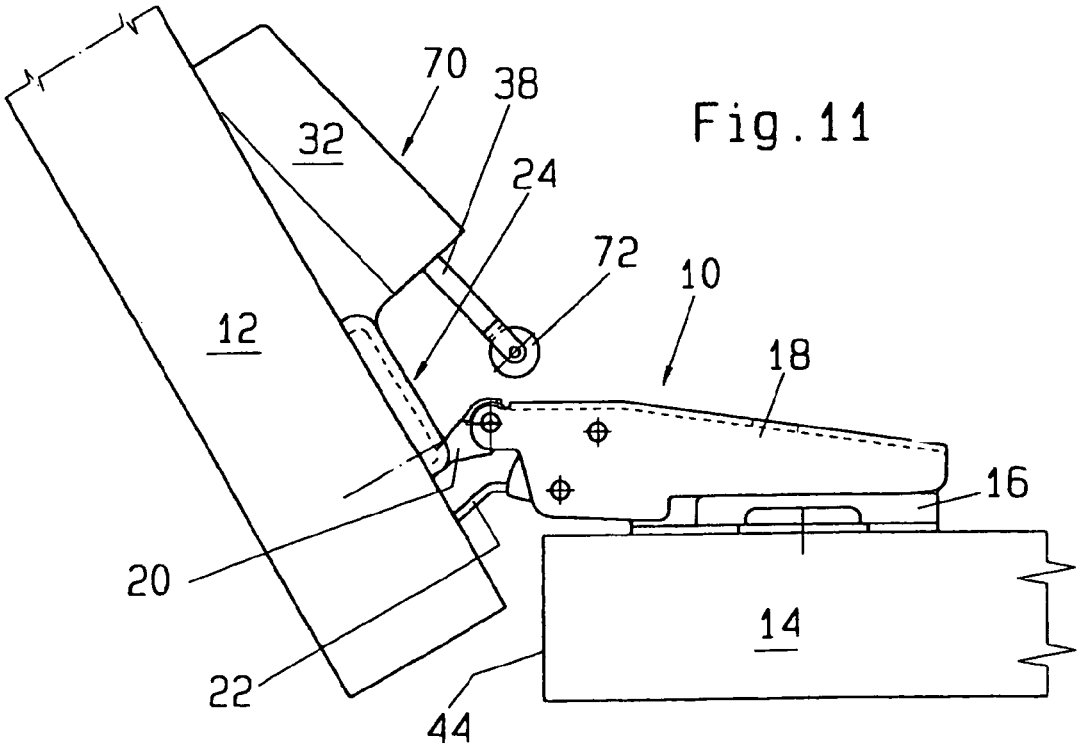

FIGS. 11 and 12 show a fourth embodiment of a damping device 70 according to the invention, which is again functionally equivalent to the damping devices described in FIGS. 1 and 2 as well as in FIGS. 3 to 5, except that the damping housing 32 is in this case integrally formed on the hinge housing 24 on the door leaf side. In this embodiment, the end of the piston rod 38 protruding from the housing 32 has instead of the buffer 42 of the damping device 30 a wheel 72 which is rotatably supported on the end of the piston rod and rolls on the upper web surface of the support arm 18 of the hinge 10, thereby preventing friction wear.

Figure 13:
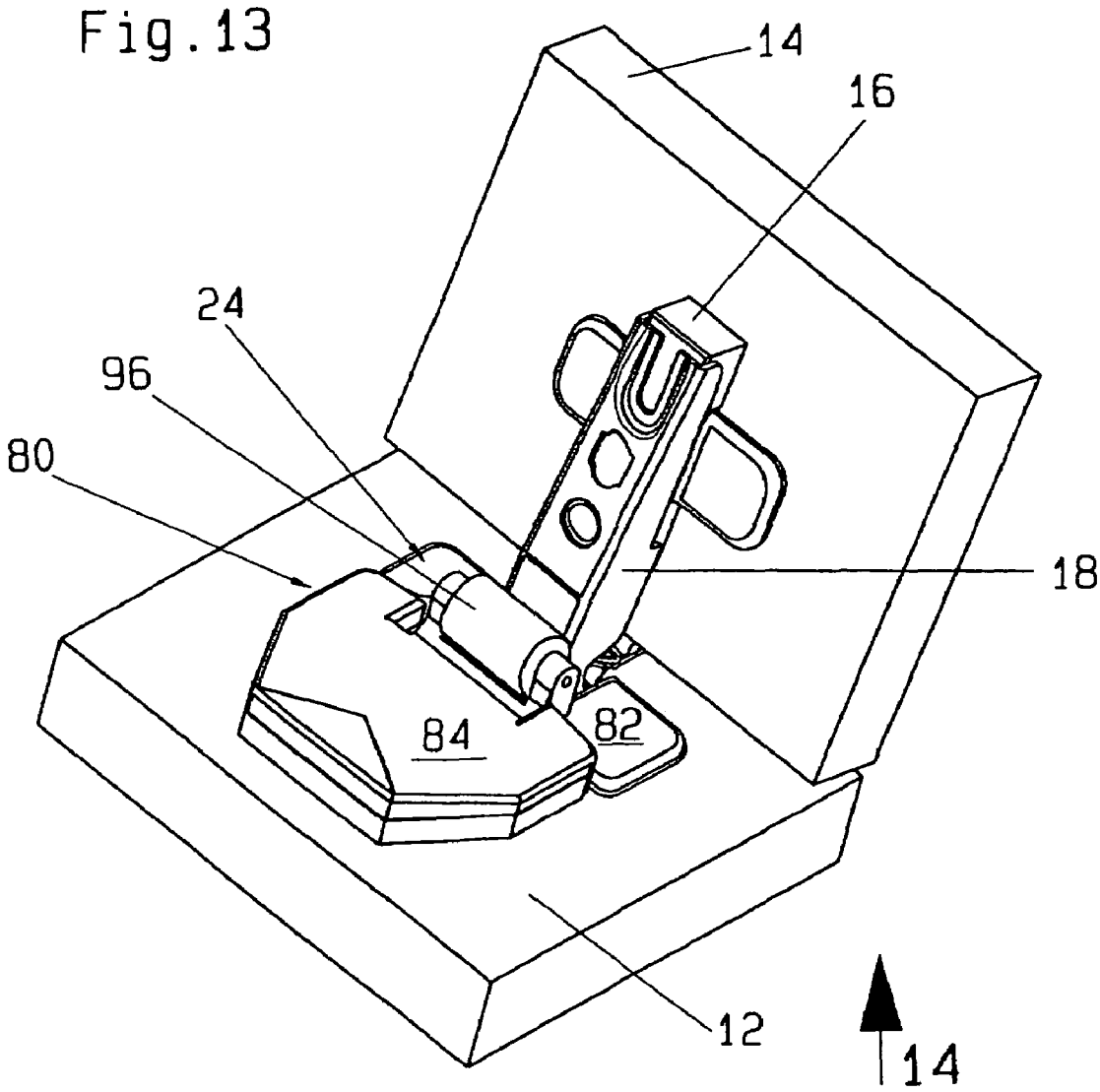
Figure 14:
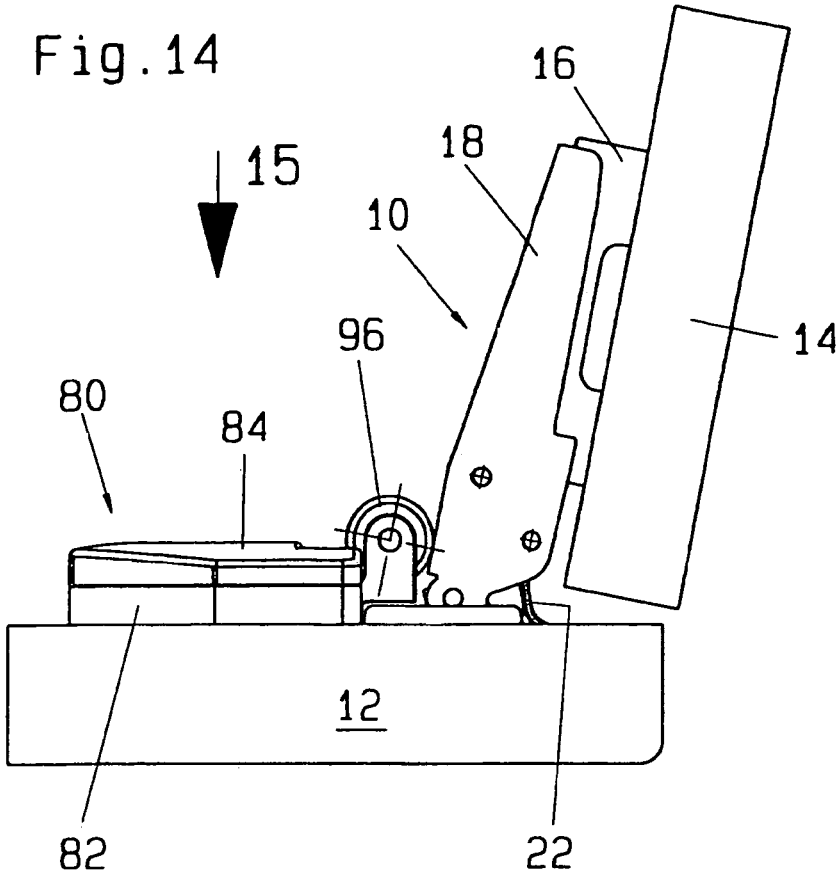
FIG. 14 a view, as seen in the direction of the arrow 14 in FIG. 12, showing the door leaf in a slightly open position.
Figure 15:
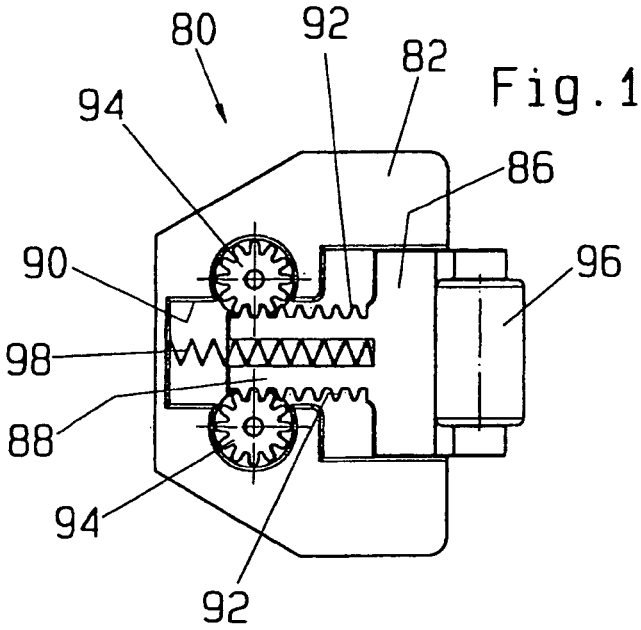
FIG. 15 a top view of the fifth embodiment of the damping device, as seen in the direction of the arrow 15 in FIG. 14, with the top cover removed.

The fifth embodiment of a damping device 80 depicted in FIGS. 13 to 15 is—like the aforedescribed damping device 70—also arranged on the door leaf side, immediately adjacent to the attachment flange 82 of the hinge cup 24 that rests against the backside of the door leaf 12. The damping device 80 has a flat damping housing 82 whose top surface is covered by a cover 84. A slider 86 is guided for longitudinal displacement in the damping housing 82 in a recess located on the side of the hinge cup, with an extension 88 extending into a matching elongated recess 90 of the damping housing 82 on the end facing away from the hinge cup. The two opposing longitudinal edges of the extension 88 are each provided with a gearing 92 in the form of a toothed rod which mesh with toothed wheels 94 that are rotatably supported in the damping housing 82. Rotary dampers (not shown) which are connected so as to rotate with the toothed wheels 94 are disposed in the damping housing 82 flush underneath the toothed wheels 94. When the slider 86 is displaced in the housing 82, the toothed wheels 94 are also rotated by the gearing 92, generating again the damping force in the rotary dampers that are coupled with the toothed wheels. As seen in FIGS. 11 and 12, when the door leaf 12 is closed, the slider 86 is displaced before the door leaf reaches its closed position, whereby a roller 96, which is rotatably arranged on the free the end of the slider 86 facing the hinge cup, stops on the upper web face of the support arm 18 of the hinge 10. The slider 86 is again returned when the door leaf 12 opens by a compression spring 98 which is supported, on one hand, on the slider 86 and, on the other hand, on the recess 90.

Figure 16:
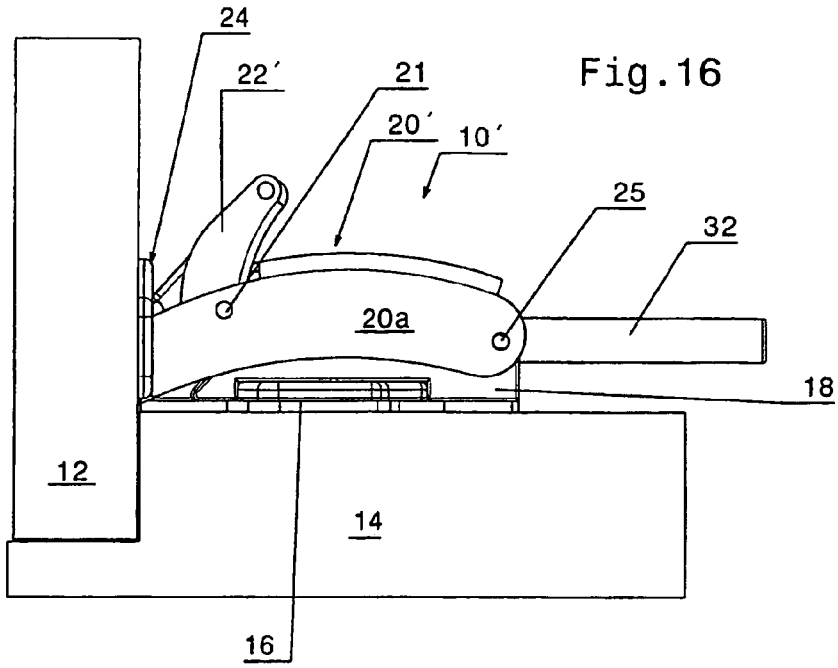
FIG. 16 a side view of a joint hinge configured for pivotally mounting a door leaf on the support wall of a cabinet body, wherein the joint hinge is provided as a sixth embodiment with a damping device according to the invention, with the door leaf shown in the closed position.
Figure 17:
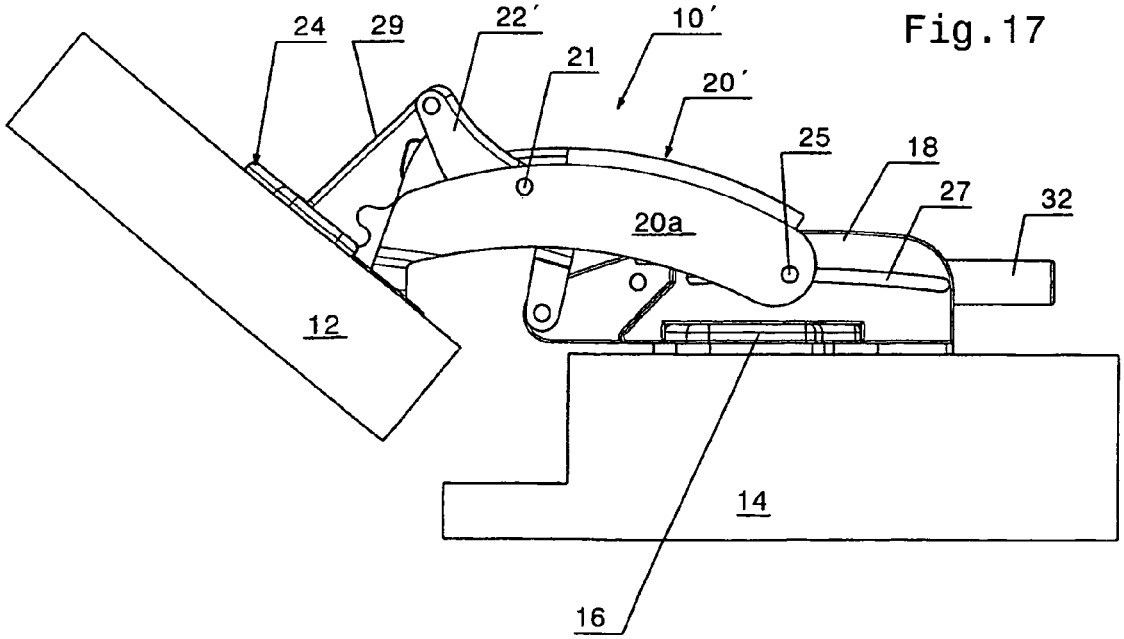
FIG. 17 the embodiment depicted in FIG. 16, with the door leaf shown in a partially open position.
Figure 18:
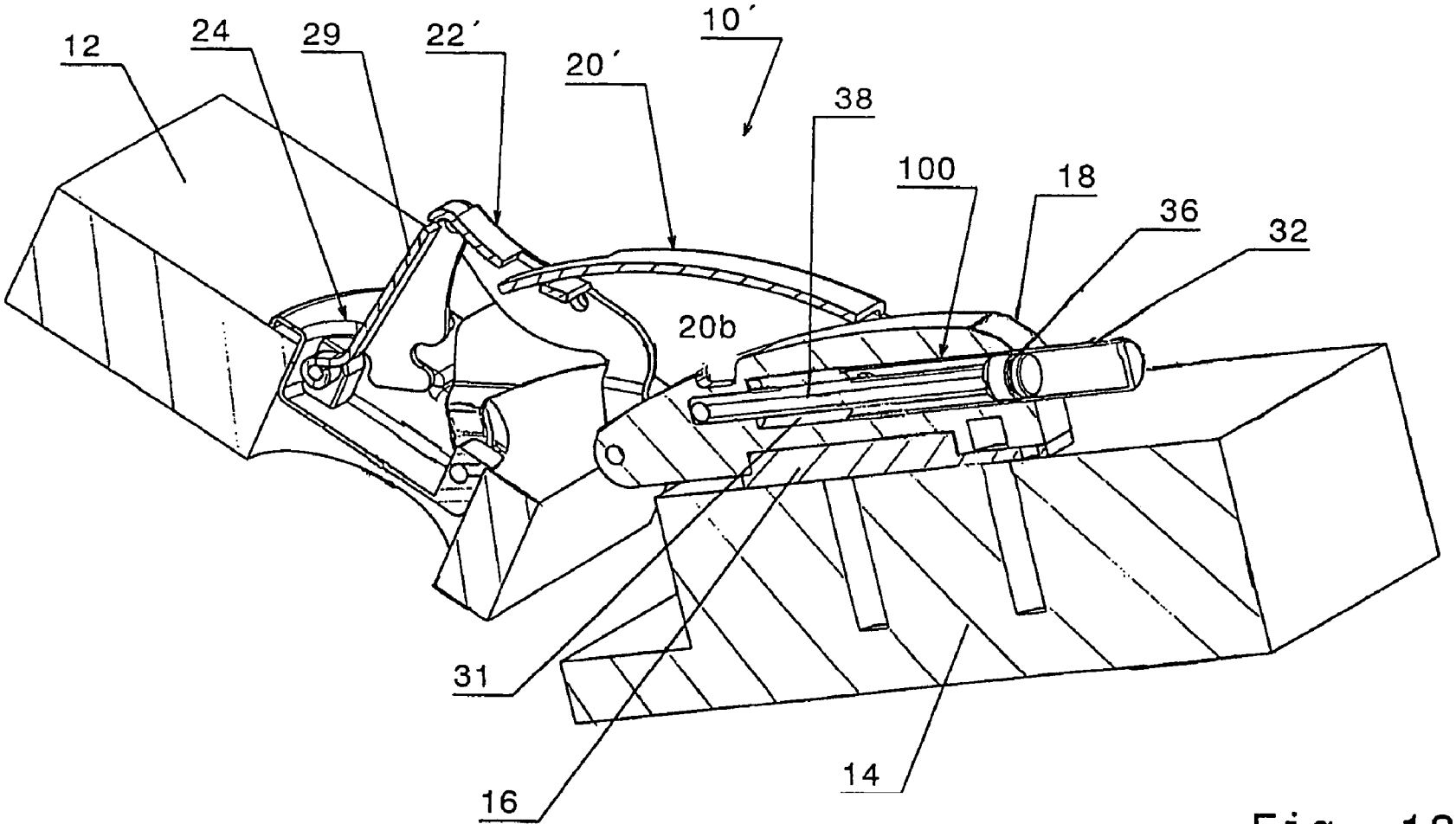
FIG. 18 the joint hinge according to FIGS. 16 and 17 in an isometric three-dimensional view in longitudinal center cross-section, with in the door leaf an open position corresponding to that of FIG. 17.

The embodiment illustrated in FIGS. 16 to 18 depicts the integration of a damping device 100 in a furniture hinge formed as a joint hinge 10'.

The joint hinge 10' has an elongated support wall mounting element 18 which is mounted on a support plate 16 secured to the support wall 14 of the cabinet body. The mounting element 18 is coupled by the links of a joint mechanism with a door leaf stop mounting element that is mounted in a recess in the form of a hinge cup 24 disposed in the corresponding door leaf 12. The joint mechanism is formed by two joint arms 20', 22' which are connected in their central region by a support pin 21' to enable a relative scissor-like pivoting motion. The angled end of the joint arm 20' on the door leaf side is pivotally supported in the hinge cup 24, whereas the opposite end disposed inside the body has two pins 25 that potrude inwardly from lateral spaced-apart parallel cheeks 20*a*, 20*b* of the joint arm 20'. The pins 25 each engage with a corresponding elongated groove 27 disposed in the opposing side faces of the support wall mounting element 18. The pins 25 and the grooves 27 hence form a sliding guide for the end of the joint arm 20' located inside the body. The guide therefore enables pivoting and longitudinal displacement of the joint arm relative to the support wall mounting element 18. The wall-side end region of the second universal joint arm 22' is pivotally coupled to the door-leaf-side front end of the support wall mounting element 18, whereas the opposite end of the second universal joint arm 22' is coupled to the hinge cup 24 via an intermediate guide rod 29. The described joint hinge 10' is so far similar to conventional joint hinges.

In the present example, the damping device 100 is arranged inside a cylindrical longitudinal bore 31 that is located in the support wall mounting element 18 and is open at its end facing the interior of the body. The damping device 100 has a piston rod 38 attached to the closed end of the longitudinal bore 31, with a piston 36 arranged on the opposite end of the piston rod 38. The piston is arranged for displacement in a damping housing formed as a damping cylinder 32 which is in drivingly connected with the inwardly pointing free ends of the pins 25 which are guided in the groves 27. Accordingly, the damping cylinder 32 moves relative to the piston 36 when the end of the joint arm 20' inside the body moves. A gaseous damping medium or a damping fluid enclosed between the piston and the damping cylinder generates the desired damping effect by way of a throttled transfer between a damping space with a decreasing volume and a damping space with an increasing volume. When the door leaf 12 is closed, the largest part of the damping cylinder 32 projects from the rearward open end of the support wall mounting element 18 into the interior of the body in the manner depicted in FIG. 16. When the door leaf 12 is opened, the damping cylinder 32 is drawn more and more into the longitudinal bore 31 by the pins 25 that move in the groves 27.

It is clear from the above description of the various embodiments that the damping devices of the invention are functionally constructed like the generally know dampers and use similar underlying operating principles. However, what is new and advantageous is that the damping devices are visually obscure in the marginal region of the door leaf that is mounted by hinges to the body of the corresponding cabinet. Moreover, the damping devices are arranged directly on or directly adjacent to the hinges themselves, which has the advantage that they are barely visible when the door leaf is open, and can be regarded as being part of the required hinges.

The invention claimed is:

1. Combination of a damping device with a joint hinge formed as an articulated joint with hinge-mounting elements, the joint hinge pivotably connecting a first furniture piece to a second furniture piece, the combination comprising a damping housing capable of being secured to the first furniture piece, with the damping housing having a cylindrical cavity containing a damping fluid and a resistance element which is displaceable relative to the damping fluid, wherein the resistance element is coupled with an actuating element extending to an outside of the housing, said actuating element being drivingly connected to the second furniture piece during at least a partial pivoting motion of the two furniture pieces relative to each other and transferring the motion received from the second furniture piece to the resistance element, wherein the damping device is arranged in a region of one of the hinge-mounting elements of the hinge which pivotally connects the two furniture pieces, and wherein at least one of the damping housing and the actuating element acts at least during the damping process on one of the hinge-mounting elements, and a piston disposed for longitudinal displacement in the cylindrical cavity as the resistance element, with a piston rod that forms the actuating element acting on the piston, wherein a free end of the piston rod facing away from the piston extends outside of the damping housing and wherein the joint hinge has two joint arms and wherein a rearward end of one of the joint arms, that is oriented towards an interior of one of the furniture pieces, is coupled with a support wall mounting element so as to enable a longitudinal motion by way of a sliding guide and a pivoting motion, wherein the sliding guide is formed by a respective one of two grooves disposed in parallel, spaced-apart side faces of the support wall mounting element that is formed as an elongated body, and a corresponding pin disposed in parallel lateral cheeks of one of the joint arms whereby the pins protrude over the side faces, wherein the pins engage with the corresponding grooves, and wherein the damping device is arranged in the cylindrical cavity that is located intermediate between the side faces of the support wall mounting element and is open on the end of the support wall mounting element facing the interior of one of the furniture pieces, and the grooves that form a portion of the sliding guide are continuous from the side faces of the support wall mounting element to the cavity.

2. Combination of claim 1, wherein the free end of the piston rod of the damping device is secured to a first end of the cylindrical cavity, and wherein an opposite end of the piston rod is moveable in the damping housing implemented as a damping cylinder, and the free inner ends of the pins that protrude from the cheeks of the joint arm through the grooves into the cylindrical cavity are drivingly connected with the damping cylinder.

* * * * *